US005331991A

United States Patent [19]

Nilsson

[11] Patent Number: 5,331,991

[45] Date of Patent: Jul. 26, 1994

[54] VENTILATION METHOD AND MEANS FOR THE SAME

[75] Inventor: Jan G. I. Nilsson, Malmö, Sweden

[73] Assignee: AB Ventilatorverken, Malmo, Sweden

[21] Appl. No.: 958,178

[22] Filed: Oct. 8, 1992

[30] Foreign Application Priority Data

Nov. 15, 1991 [SE] Sweden ..... 9103371

[51] Int. Cl.[5] ..... E04H 15/14

[52] U.S. Cl. ..... 135/93; 135/91; 52/211; 454/228; 454/236

[58] Field of Search ..... 135/91, 93 OR; 52/2.11, 52/2.16, 2.17; 454/228, 236, 306

[56] References Cited

U.S. PATENT DOCUMENTS

| | | | |
|---|---|---|---|
| 2,194,497 | 3/1940 | Crosley, Jr. | 135/93 |
| 2,463,090 | 3/1949 | Dixon et al. | 135/91 |
| 2,910,994 | 11/1959 | Joy | 52/2.11 |
| 3,118,401 | 1/1964 | Platt | 135/93 |
| 3,261,659 | 7/1966 | Schwichtenberg et al. | 135/93 |
| 3,265,059 | 8/1966 | Matthews | 135/93 |
| 3,272,199 | 9/1966 | Matthews | 135/93 |
| 3,766,844 | 9/1973 | Donnelly et al. | 135/93 |
| 4,000,749 | 1/1977 | Busco | 52/2.17 |
| 4,296,960 | 10/1981 | Winchester | 52/2.17 |
| 4,530,272 | 7/1985 | Stokes | 98/34.5 |
| 4,974,829 | 12/1990 | Gamow et al. | 52/2.17 |
| 5,090,972 | 2/1992 | Eller et al. | 55/20 |

FOREIGN PATENT DOCUMENTS

| | | |
|---|---|---|
| 075483 | 3/1983 | European Pat. Off. . |
| 345600 | 12/1989 | European Pat. Off. . |
| 3028707 | 6/1981 | Fed. Rep. of Germany . |
| 3126032 | 10/1990 | Fed. Rep. of Germany . |

*Primary Examiner*—Carl D. Friedman
*Assistant Examiner*—Wynn Wood
*Attorney, Agent, or Firm*—Burns, Doane, Swecker & Mathis

[57] ABSTRACT

The invention relates to a method of establishing and maintaining in sealed tents or the like mobile units, an environment which is independent of the surroundings with regard to temperature and contamination. The invention is characterized by taking air from the surroundings, extracting contaminated particles and gas from the air by filtration, and causing the air to pass into the mobile unit so as to establish a predetermined air pressure which is higher than the air pressure of the surroundings. The filtered air is mixed with air recycled from within the mobile unit when the aforesaid predetermined air pressure has been reached and mixing of the filtered air with recycled air is continued for as long as the internal air pressure is equal to or greater than the predetermined air pressure. The air mixture is heated or cooled to a predetermined temperature and is then distributed essentially uniformly in the mobile unit and filtered, in conjunction therewith, so as to extract any remaining particles and gas. The invention also relates to an arrangement for carrying out the method.

9 Claims, 3 Drawing Sheets

VENTILATION METHOD AND MEANS FOR THE SAME

Figure 1:
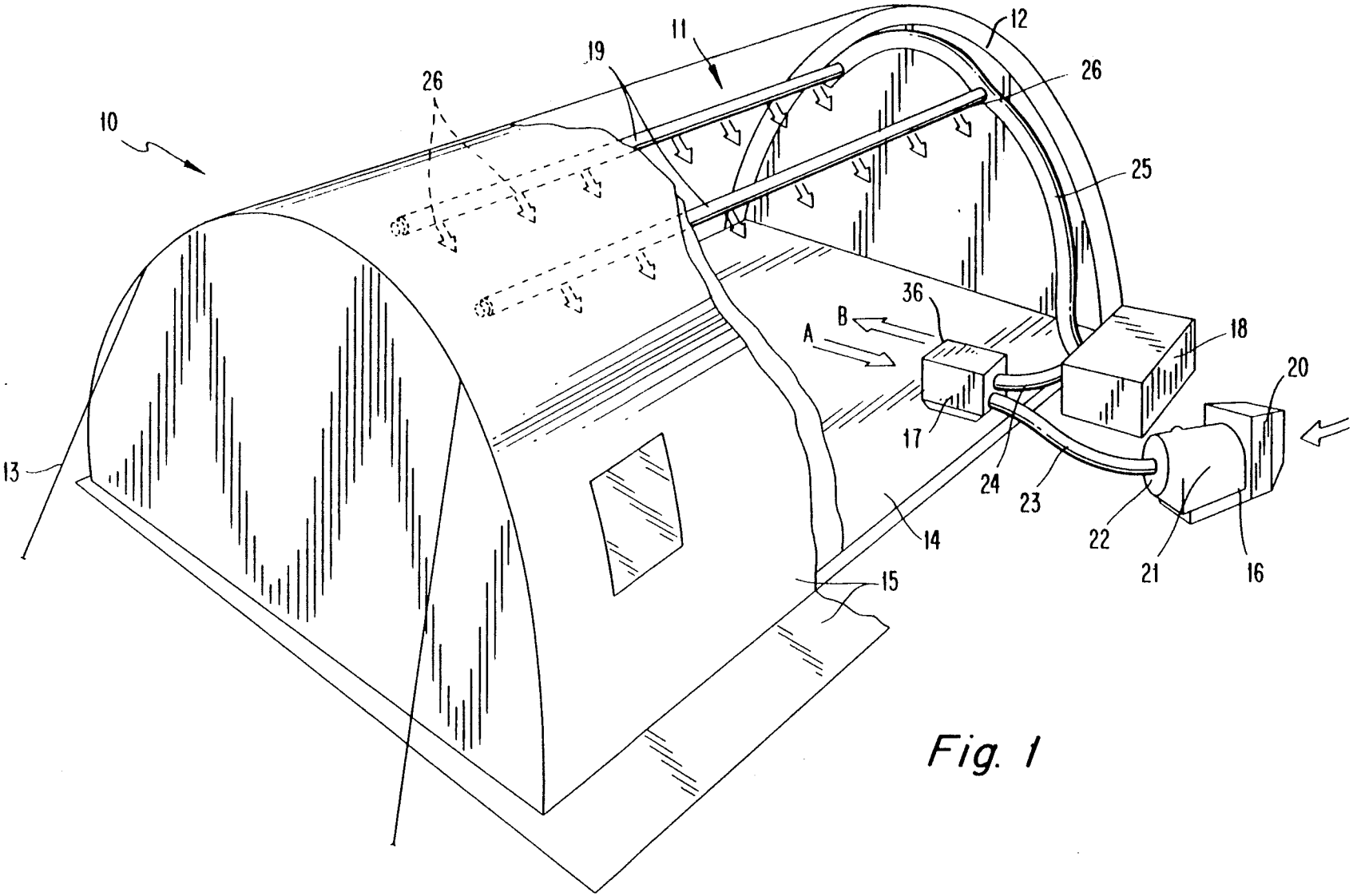

The present invention relates to a method for obtaining and maintaining in sealed tents or similar mobile units an environment which is independent of the environment of the surroundings with regard to both temperature and contamination. The invention also relates to means for carrying out the method.

The invention finds particular application in mobile medical treatment units intended for defense or civil defense purposes, but also finds general application for use in emergency situations where the emission or production of poisonous gases or particles contaminate the surroundings and where people in or close to the area of the emergency or catastrophe require immediate degasification and treatment.

It is known to use tents or similar mobile units, either individually or in combination with one another, as military hospitals and similar medical treatment units, for instance. Both tents and other mobile units, such as prefabricated accommodation structures, can be used in this regard. One requirement governing the use of these units in a contaminated ambient environment is that contaminated air is unable to enter the area or space constructed from a combination of such mobile units. It is possible to provide sealed tents and also sealed tent combinations. SE-B-459 194 (corresponding to U.S. Pat. No. 4,979,532) teaches one such sealing device in the form of an inflatable hose-like element which functions to seal joints between the various tent units and which is thus particularly useful in the present context. By sealed tent is meant in the present context a tent in which any form of exchange with the ambient atmosphere is largely eliminated, even though small leakages cannot be avoided in practice. Consequently, it is necessary to place the entire space under an overpressure, i.e. the internal air pressure shall always be greater than the prevailing atmospheric pressure, so as to prevent the ingress of ambient air.

The problems encountered when using internally pressurized sealed tents reside in the need for ventilation and the need to heat or cool the interior of said space. Neither shall the occupants of the tent be placed at risk, so as to require the provision of personal protective equipment.

It may happen that people entering the sealed space, or tent, carry with them contaminating particles or gas, despite being degasified or decontaminated outside said space or tent. Another problem that must be solved when coupling together a number of such mobile units resides in the avoidance of draughts between the units, this being particularly important in the case of medic units.

There is a need for improvement of mobile medical treatment units with regard to protection against intentional chemical and/or biological attack, for instance in the form of poisonous gases or lethal bacteria used in the battlefield, or the unintentional emission of poisonous substances, so that personnel are able to carry out their duties without obstruction from personal protective equipment, and so that the condition of the sick is not made worse by the ingress of poisonous substances resulting from chemical attacks or the internal environment due to an excessively low or an excessively high temperature.

One requirement placed on mobile medical treatment units that may be subjected to an external contaminated environment is that it must be possible to heat or air-condition (cool) the units without risk of contaminating gases or other lethal or harmful substances entering the units, and also to eliminate the risk of contaminating gases or particles that enter the units in some other way, for instance by adsorption on people or materials entering the units from outside, from spreading throughout the internal environment.

To this end, the invention provides a method for maintaining an environment which is independent of the surroundings and also provides means for carrying out the method. The inventive method and inventive means are characterized by the characteristic features set forth in the following method and apparatus Claims.

According to the present invention, air for the mobile unit is directed along one of two flow paths depending on the pressure conditions sensed in the mobile unit. If the pressure is below a predetermined pressure, filtered external air passes directly into the mobile unit to raise the pressure in the unit to the predetermined pressure. Once the predetermined pressure is reached, filtered external air is mixed with air drawn from the mobile unit and the mixture is directed to an air heating/cooling conditioning unit and the conditioned air is distributed in the mobile unit.

Thus, in accordance with the invention, air is first filtered to remove contaminating particles and contaminating gas from the air. The air is then caused to pass into the mobile unit in order to establish therein a predetermined air pressure which is higher than the pressure of the outside ambient air. This filtering process is conveniently carried out in conjunction with imparting an overpressure to the air prior to its passage into the mobile unit. Provided that the predetermined air pressure prevails or is exceeded within the internal space of the mobile unit, the filtered air is caused to mix with recycled air from within the internal space. The resultant air mixture is then heated or cooled to a predetermined temperature and is then distributed generally evenly within the interior space of the mobile unit. The air mixture is filtered in conjunction herewith, with the intention of removing any particles and gas that may possibly be carried by the air.

In those cases when several tent units or other, similar mobile units have been joined together in selective, combined configurations so as to form a larger, internal sealed space, air and recycled air are conveniently delivered to each separate unit in the same manner as that defined in the main Claim, therewith greatly eliminating the risk of draughts suddenly occurring between respective units.

Figure 2:
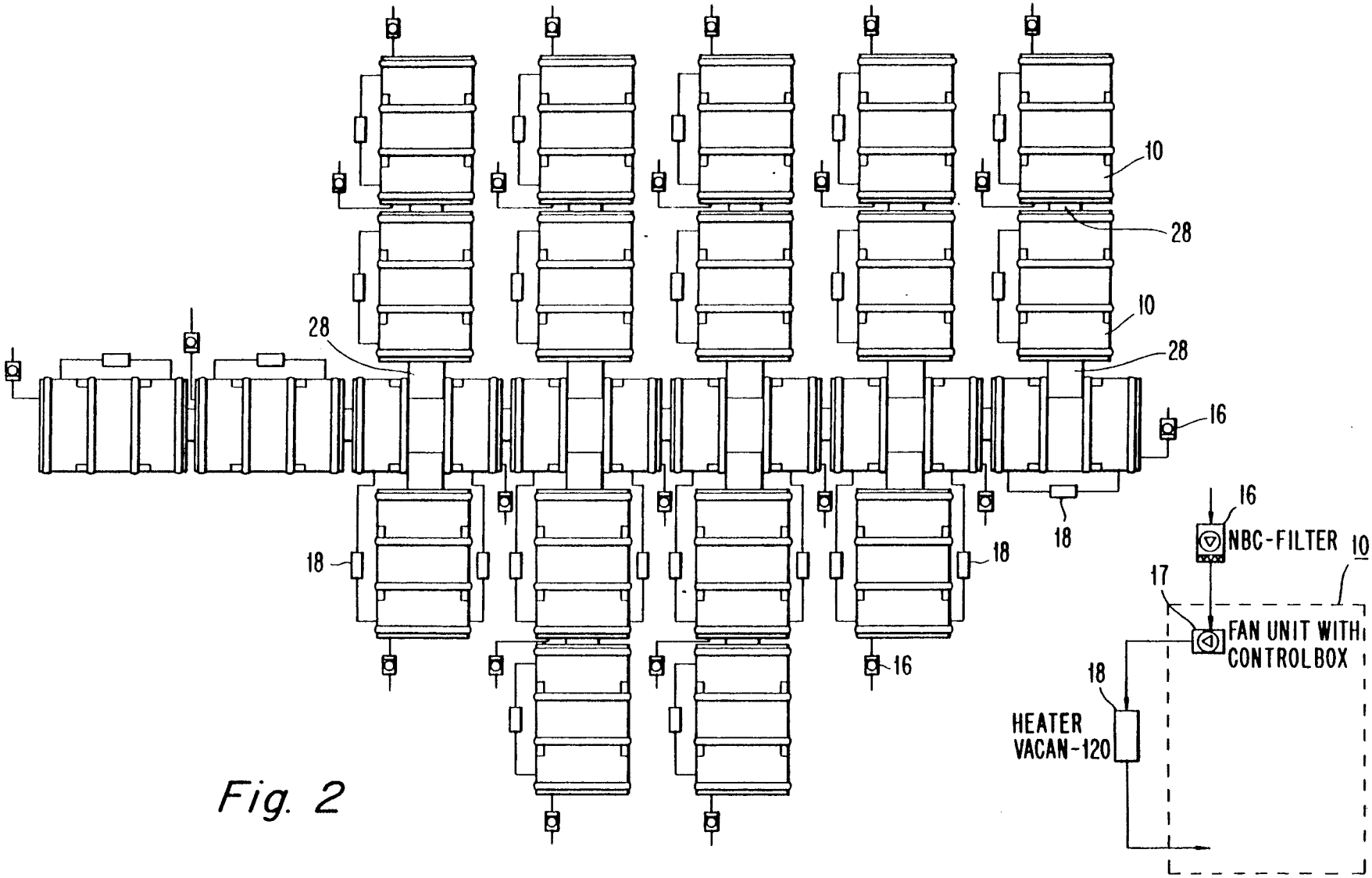
Figure 3:
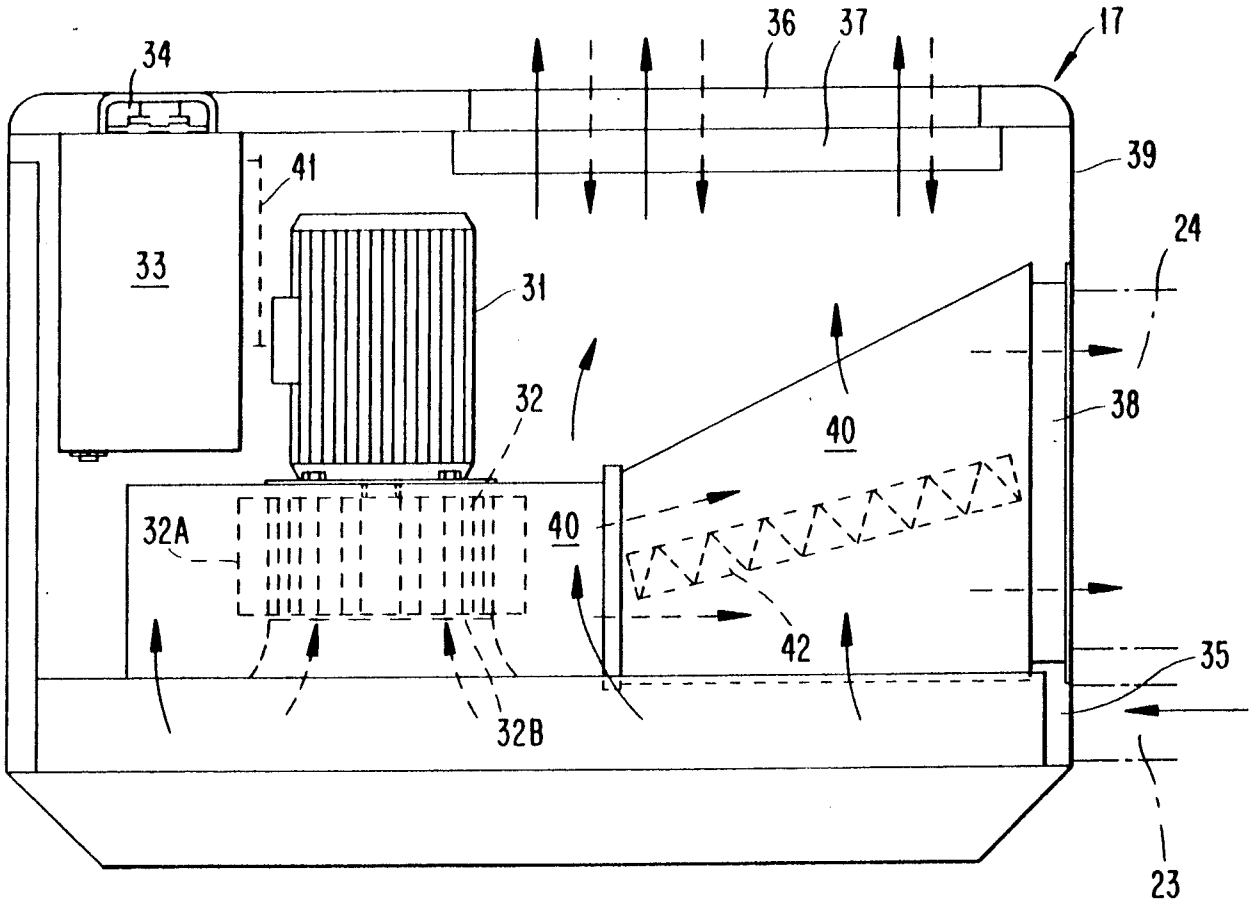

The invention will now be described in more detail with reference to the accompanying drawings and also with reference to preferred embodiments of the inventive method and with reference to devices set forth in the Claims, in which drawings FIG. 1 is a perspective view, partly in section, of a tent unit where the inventive method is illustrated; FIG. 2 illustrates a possible combination of tent units for use, e.g., as a military hospital and with which the inventive method is applied; and FIG. 3 is a side view of a fan unit with one side of the unit removed, this fan unit constituting a preferred embodiment of the arrangement according to Claim 3.

FIG. 1 illustrates a tent unit 10 provided with devices for achieving an environment which is independent of the surrounding environment, in accordance with the invention. The tent unit 10 includes an upper structure 11 which is held stretched, or tensioned, with the aid of inflated, arcuate support tubes 12 and guys 13, and a floor structure 14 which is sealed against the upper roof structure 11. As shown in FIG. 1, the upper structure 11 may be provided with a guard 15, a so-called fly, which prevents poisonous gases and particles from penetrating into the tent unit 10 and protects against fall-out.

The tent unit 10 is also provided with devices which maintain an overpressure and a non-contaminated environment within the unit. In the case of the preferred embodiment illustrated in FIG. 1, these devices include a filter unit 16, a control/blower unit 17, a heating/cooling unit 18 and air-distribution channels 19. When these devices are in operation, air is drawn into the filter unit 16 as shown by an arrow, under the influence of a suction fan (not shown) incorporated in the filter unit 16. The air first passes through a cyclone part 20 of the filter unit 16, where large particles are extracted from the air flow, and then through a fine-particle filter 21. When all solids have been removed from the air, the air passes through an active carbon filter 22, which extracts poisonous gases from the air. The thus filtered air is then passed through a conduit 23 to the control/blower unit 17, the function and construction of which will be described in more detail herebelow with reference to FIG. 3. Provided that the air pressure within the tent unit 10 does not fall beneath the value predetermined in the present context, both the filtered air, which is delivered through the conduit 23, and the air recycled from the tent unit 10, entering the blower unit 17 through a port 36 as indicated by arrow A, are conducted through a conduit 24 to the heating/cooling unit 18 and there attemperated to a predetermined temperature, which may thus be higher or lower than the ambient temperature. In principle, the unit, or assembly, 18 may comprise two separate units, one for heating the air and one for air-conditioning purposes, or may include only one of these units, all depending on external circumstances. The attemperated air is then passed through a conduit 25 to the aforementioned two air-distribution channels 19, which in the illustrated embodiment are mounted in the upper part of the tent unit 10, as in the case of cool air. In the case of distribution of heated air, the distribution channels or ducts 19 are mounted in the lower part of the tent unit 10. Air is distributed by the air-distribution channels 19 in the interior of the tent unit 10, as indicated by the arrow, through the medium of downwardly extending air exhaust openings 26 disposed along the full length of the channels. In the case of heated air, the openings 26 are directed horizontally or upwards. In this case, the openings 26 may be distributed evenly along the long axis of the channels 19 or, as indicated in the Figure, spaced at a given distance apart. The air-distribution channels 19 are comprised of pipes, tubes or hoses provided with exhaust openings 26 which are so arranged that the air is forced to pass through filter means (not shown) prior to entering the interior of the tent unit 10. In this case, the filter devices may conveniently be comprised of several layers, for instance non-woven filters in combination with adsorbents or absorbents, such as active carbon, for instance. Adsorbents or absorbents may form one layer which is embraced on both sides by non-woven filter material which functions to hold the adsorbent or absorbent in place. If the air pressure in a tent unit 10 falls beneath the predetermined pressure level, for instance as a result of unintentional and, in practice, unavoidable leakage or seepage, or when tent entrances are opened, the control/blower unit 17 will ensure that the incoming, filtered air will pass straight into the internal space of the tent unit 10 through port 36, thus in a direction from the unit 17 indicated by the arrow B shown in the Figure. This will be described in more detail herebelow. The air pressure in the tent unit 10 is quickly readjusted to the desired air pressure in this way.

FIG. 2 illustrates an array (combination) of several tent units 10 which are mutually connected, as shown at reference numerals 28, with the aid of the device taught, for instance, by SE-B-459 194 (U.S. Pat. No. 4,979,532). The Figure also shows filter units 16 which function to deliver air to, in principle, each tent unit 10, and also heating/cooling units 18 (VA).

For the sake of illustration, there is shown to the right of FIG. 2 a tent unit 10 which is equipped with a filter unit 16 (described in the Figure as an "NBC-Filter"), a control/blower unit 17 ("FAN-UNIT with control box"), and a unit 18 (in this case, a heating unit designated "HEATER VACAN-120").

FIG. 3 illustrates a control/blower unit 17 which can be considered to constitute the central device in the system required to carry out the inventive method. The control/blower unit 17 is shown in side view with one side removed, so as to show the inner components of the unit. As will be apparent from, e.g., FIG. 1, a unit 17 shall be placed within each tent unit 10. The blower unit 17 includes an impeller 32, which is driven by an electric motor 31, and a control device 33 which includes a pressure sensor 34. Provided in the lower part of the device is an inlet 35 for incoming filtered air, which enters the device through the conduit 23 (here shown in broken lines). Provided in the upper side or sealing of the unit 17 is a port 36 which includes a particle-capturing filter 37. The port 36 serves selectively as an outlet of the system when air is passed directly into the mobile unit to attain the predetermined pressure and as an inlet for air recycled from the mobile unit for heating or cooling.

Arranged in the short wall 39 of the unit casing is a second outlet 38 which connects with the conduit 24, here shown in a broken line. Also included within the unit 17 is a channel 40 which is connected to the outlet or exhaust side 32A of the fan 32 and also to the second outlet 38. The channel 40 may be provided with a silencer 42 and is arranged so that air is permitted to flow vertically on both sides of the channel, as indicated by the upwardly pointing full-line arrows, said air continuing to flow in this direction until the fan 32 is started-up. The filtered air which enters through the conduit 23 will therewith flow upwards through the blower unit 17 on both sides of the fan 32, through the channel 40 and out through the filter 37 and the first outlet 36 and directly into the tent unit 10. When a preset pressure is reached in the control device 33, this pressure being sensed by the device 34, an electric signal is sent to the fan motor 31, over a line 41, causing the fan 32 to be brought into operation. As a result, air will be drawn into the inlet side 32B of the fan 32 and, as indicated by the broken-line arrows, will instead exit through the exhaust side 32A of the fan 32 and be conducted to the second outlet 38, through the conduit 40. Air from the interior of the tent unit 10 is forced to flow downwards through the port 36 simultaneously with the external, filtered air, as indicated by the downwardly pointed, broken-line arrows, and is mixed at the inlet side 32B of the fan 32 with the filtered air that enters externally through the conduit 23, and passes out through the outlet opening 38, through the channel, and is thus recycled back to the tent unit 10.

Thus, when the air pressure is higher than the air pressure desired in respective tent units, fresh, filtered air and recycled air are passed back to the interior of the tent unit. Thus, in practice, the air lost to atmosphere as a result of unavoidable leakage is compensated by filtered, external air, provided that the air pressure is maintained in the tent unit. If leakage increases, the air pressure will gradually fall to beneath the desired, predetermined value, whereupon the pressure sensor 34 in the control unit 33 will send a signal to the fan 32 and the fan is switched-off as a result thereof. The filtered air will now again pass directly into the tent unit 10 through the port 36, until the predetermined air pressure is reached, whereafter the aforedescribed procedure is repeated.

I claim:

1. A method of establishing and sustaining in sealed tents or similar mobile units an environment which is independent of the external surroundings with regard to temperature and contamination, comprising;

receiving air from the external surroundings that has been filtered in a manner to extract contaminating particles and gas therefrom and passing the air directly into the mobile unit so as to establish a predetermined air pressure which is higher than the external ambient air pressure;

mixing filtered air with air recycled from within the mobile unit when said predetermined air pressure is reached, and continuing said mixing process for as long as an air pressure equal to or higher than said predetermined air pressure prevails within the mobile unit;

heating or cooling the air mixture to a predetermined temperature; and subsequently distributing the air mixture substantially uniformly in the mobile unit while, in conjunction therewith, filtering said air mixture to extract any remaining particles and gas therefrom.

2. A method according to claim 1, wherein several tents or like mobile units are joined together in selected combinations so as to form a larger, sealed space, characterized by delivering filtered air to each individual unit and circulating said air in said unit.

3. An air control and conditioning apparatus for establishing and sustaining a predetermined environment in a sealed mobile unit, comprising;

an inlet receiving blown, filtered external air;

a port communicating directly with the mobile unit supplying air to maintain a predetermined air pressure within the mobile unit;

an outlet connected to an air-distribution channel within the mobile unit;

a cooling/heating unit located between the outlet and the air-distribution channel;

a motor-driven fan; and a pressure sensing control device, wherein the fan is connected electrically to the control device and, upon receipt of a signal from the control device, causes blown, filtered external air to flow in through the inlet and mix with air drawn in from the mobile unit through the port and to exit through the outlet to the cooling/heating unit.

4. An apparatus according to claim 3, wherein the air distribution channels include at least one of pipes, tubes and hoses which extend horizontally in the upper or the lower part of the mobile unit and which are provided with air outlet openings disposed in combination with filter means along substantially the full length of the unit.

5. An apparatus according to claim 4, wherein the filter devices include layers of active carbon for extracting fine particulate solids and gaseous impurities from the air.

6. A method of establishing and sustaining a predetermined environment in a sealed mobile unit, comprising:

sensing a pressure in a sealed mobile unit;

receiving blown, external air filtered to extract contaminating particles and gas;

allowing the filtered air to flow directly into a sealed mobile unit if the pressure sensed in the mobile unit is below a predetermined pressure, said predetermined pressure being above ambient pressure;

activating a fan to draw air from the mobile unit and mix the air with inflowing filtered external air if the predetermined pressure sensed is above ambient pressure;

blowing the mixed air to a conditioning unit for one of selectively heating and cooling the air;

filtering the conditioned air to extract contaminating particles and gas; and, distributing the filtered conditioned air to the mobile unit.

7. An apparatus as claimed in claim 3, further comprising a second fan for blowing ambient air to the inlet and a filter interposed between the second fan and the inlet for removing contaminating particles and gas from the blown air.

8. An apparatus as claimed in claim 3, further comprising a filter unit interposed in the air distribution channel for removing contaminating particles and gas from the conditioned air before it is distributed to the mobile unit.

9. An apparatus as claimed in claim 3, further comprising a particle contaminant removing filter interposed in the port.

* * * * *